US012779528B2

(12) United States Patent
Renard et al.

(10) Patent No.: US 12,779,528 B2
(45) Date of Patent: Nov. 3, 2026

(54) FASTENER INSTALLATION NOSE AND INSTALLATION SET

(71) Applicant: LISI AEROSPACE, Paris (FR)

(72) Inventors: Laurent Renard, Vierzon (FR); Martial Broucke, Delincourt (FR)

(73) Assignee: LISI AEROSPACE, Paris (FR)

( * ) Notice: Subject to any disclaimer, the term of this patent is extended or adjusted under 35 U.S.C. 154(b) by 0 days.

(21) Appl. No.: 19/357,194

(22) Filed: Oct. 14, 2025

(65) Prior Publication Data

US 2026/0102817 A1 Apr. 16, 2026

(30) Foreign Application Priority Data

Oct. 16, 2024 (FR) ..... 2411209

(51) Int. Cl.
*B21J 15/36* (2006.01)
*B21J 15/04* (2006.01)
*B21J 15/10* (2006.01)

(52) U.S. Cl.
CPC ..... *B21J 15/365* (2013.01); *B21J 15/105* (2013.01); *B21J 15/045* (2013.01)

(58) Field of Classification Search
CPC ..... B21J 15/365; B21J 15/105; B21J 15/045
See application file for complete search history.

(56) References Cited

U.S. PATENT DOCUMENTS 6,182,345 B1 * 2/2001 Travis ..... B21J 15/30 72/391.2
8,371,017 B1 * 2/2013 Nikkel ..... B21J 15/046 29/525.01
8,640,322 B1 * 2/2014 Nikkel ..... B21J 15/043 29/524.1
11,148,188 B2 * 10/2021 Simpson ..... B21J 15/105
11,292,050 B1 * 4/2022 Spilker ..... B21J 15/30
2008/0222868 A1 9/2008 Dear
2010/0275424 A1 * 11/2010 Masugata ..... B21J 15/326 29/243.521
2013/0205556 A1 * 8/2013 Erni ..... B21J 15/105 29/243.521

FOREIGN PATENT DOCUMENTS

CN 204565044 U 8/2015
EP 2894356 A1 7/2015
EP 3539685 A1 9/2019
WO WO 2024/002430 A1 1/2024

OTHER PUBLICATIONS

Search Report dated Apr. 17, 2025 for FR App. Ser. No. 2411209.

* cited by examiner

*Primary Examiner* — Michelle Lopez
(74) *Attorney, Agent, or Firm* — Henricks Slavin LLP

(57) ABSTRACT

An installation nose (100) for installing a fastener (12) in a structure (14). The fastener includes a pin (16) provided with a head (22), a gripping element (26) and a breakneck groove (28). The installation nose includes a hollow body (110), with a first front opening (120), able to accommodate the gripping element (26), a bushing (112), movable relative to the hollow body and including a second front opening (130), aligned with the first front opening, a retaining device (114), able to block the gripping element (26) in the second front opening, and a tubular element (115). The retaining device and the tubular element are movable in translation in the bushing between a first axial position and a second axial position.

11 Claims, 8 Drawing Sheets

FASTENER INSTALLATION NOSE AND INSTALLATION SET

The present invention relates to an installation nose for installing a fastener in a structure, the fastener being of the type comprising: a pin extending along a fastening axis and provided with a head; a gripping element, projecting axially relative to the head; and a breakneck groove, positioned between the head and the gripping element, the groove being likely to be broken under the application of a break torque around the fastening axis; the installation nose comprising: a hollow body, extending along a main axis, a front end of the hollow body comprising a first front opening, able to accommodate the gripping element of the fastener; a bushing, accommodated in the hollow body and movable in translation and rotation relative to the hollow body, a front end of the bushing comprising a second front opening, axially aligned with the first front opening of the hollow body; and a retaining device, able to block the gripping element of the fastener in the second front opening of the bushing.

The present invention relates in particular to the assembly of blind fasteners, especially in a structure comprising only one accessible face.

Such an installation nose is described in particular in document EP3539685, in the name of LISI Aerospace.

The operation of this installation nose and the associated installation tooling requires that the gripping element, separated from the installed fastener, be ejected from the front of the installation nose before a new fastener is inserted into the installation nose. The gripping element is thus ejected from the installation nose manually by an operator who pulls a ring backwards, the gripping element being pushed by an ejection rod with a certain thrust force. If the operator does not have a container positioned nearby, the gripping element may be ejected onto the ground or inside the structure, which may pose a risk of accident to the operator or may require a search to find the lost gripping element.

In order to solve these problems, the invention relates to an installation nose of the aforementioned type, further comprising a first tubular element, extending into the bushing along the main axis, between an open front end and an open rear end; the front end of the first tubular element being held in contact with the retaining device; an internal radial dimension of the first tubular element, from the front end to the rear end, being greater than or equal to a maximum radial dimension of the gripping element of the fastener; the retaining device and the first tubular element being movable in translation in the bushing between a first and a second axial position.

Such an installation nose allows the gripping element of the fastener to be removed through the rear of the tooling or temporarily stored in a compartment of the tooling.

In addition to other beneficial aspects of the invention, the installation nose comprises one or more of the following features, taken individually or according to any technically possible combination:

- the retaining device comprises at least two clamps, at least partially accommodated in the bushing and positioned around the main axis; a front end of each of the clamps comprising a hook; the clamps being radially movable relative to the hollow body between an extended configuration and a retracted configuration, each hook being closer to the main axis in the retracted configuration than in the extended configuration;

- in the first position, the clamps are held in the retracted configuration and in the second position, the clamps are in the extended configuration;
- the second front opening of the bushing has a first radial dimension; the front end of the bushing comprises an internal surface widening towards the rear, such that at a non-zero distance from the second opening, the internal surface has a second radial dimension, strictly greater than the first radial dimension; and in the first axial position of the clamps, the hooks are positioned in the second front opening of the bushing;
- the installation nose further comprises: a first compression spring, extending along the main axis between two ends; and a second tubular element, extending into the first tubular element along the main axis between an open front end and an open rear end, the second tubular element being fixed in translation relative to the bushing, the first compression spring abutting respectively against the first tubular element and against one of the second tubular element and the bushing, the first and second positions of the first tubular element corresponding respectively to a first and a second state of compression of the first spring;
- the installation nose further comprises a drive surface, able to cooperate with the gripping element of the fastener to drive the gripping element in rotation;
- the drive surface is carried by the front end of the first tubular element;
- the drive surface is formed by the clamps in the retracted configuration;
- the retaining device further comprises a clamp body integral with a rear end of each of the clamps, the clamp body being rotationally blocked in the bushing;
- the front end of the bushing comprises at least two axial slots, positioned around the main axis; the front end of the first tubular element comprises a front surface, substantially perpendicular to the main axis; each clamp comprises a tab, able to slide in one of the axial slots of the bushing, between the first and the second axial positions; and a rear end of each of the clamps comprises a rear surface, able to slide radially against the front surface of the front end of the first tubular element;
- the front surface of the front end of the tubular element forms an angle of between 0° and 15° with a line perpendicular to the main axis.

The invention also relates to an installation set for installing a fastener in a structure, comprising an installation nose as described above.

The invention will become clearer upon reading the following description, which is provided solely as a non-limiting example, and with reference to the drawings, in which.

Figure 1:
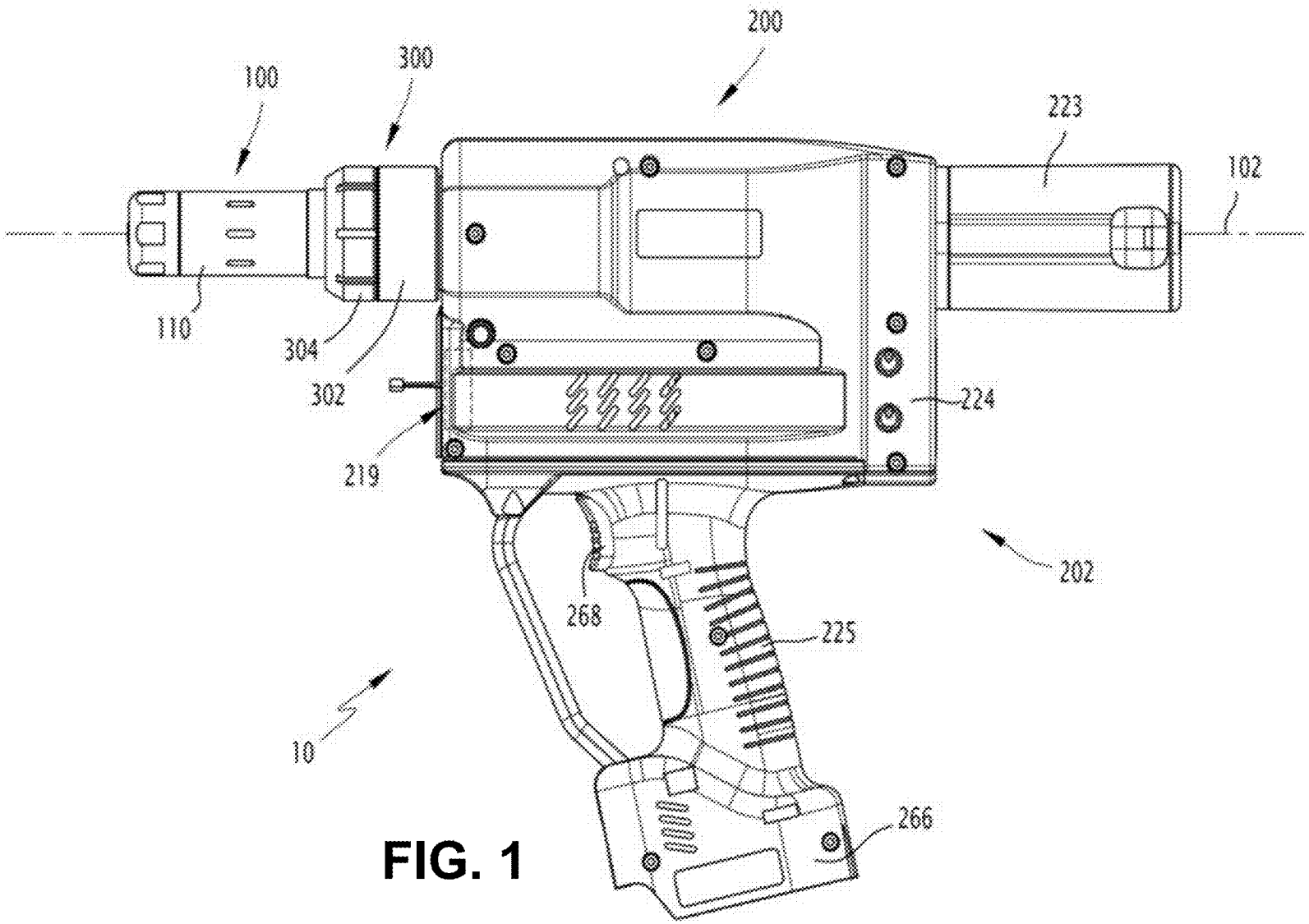
FIG. 1 is a side view of an installation set according to one embodiment of the invention.
Figure 7:
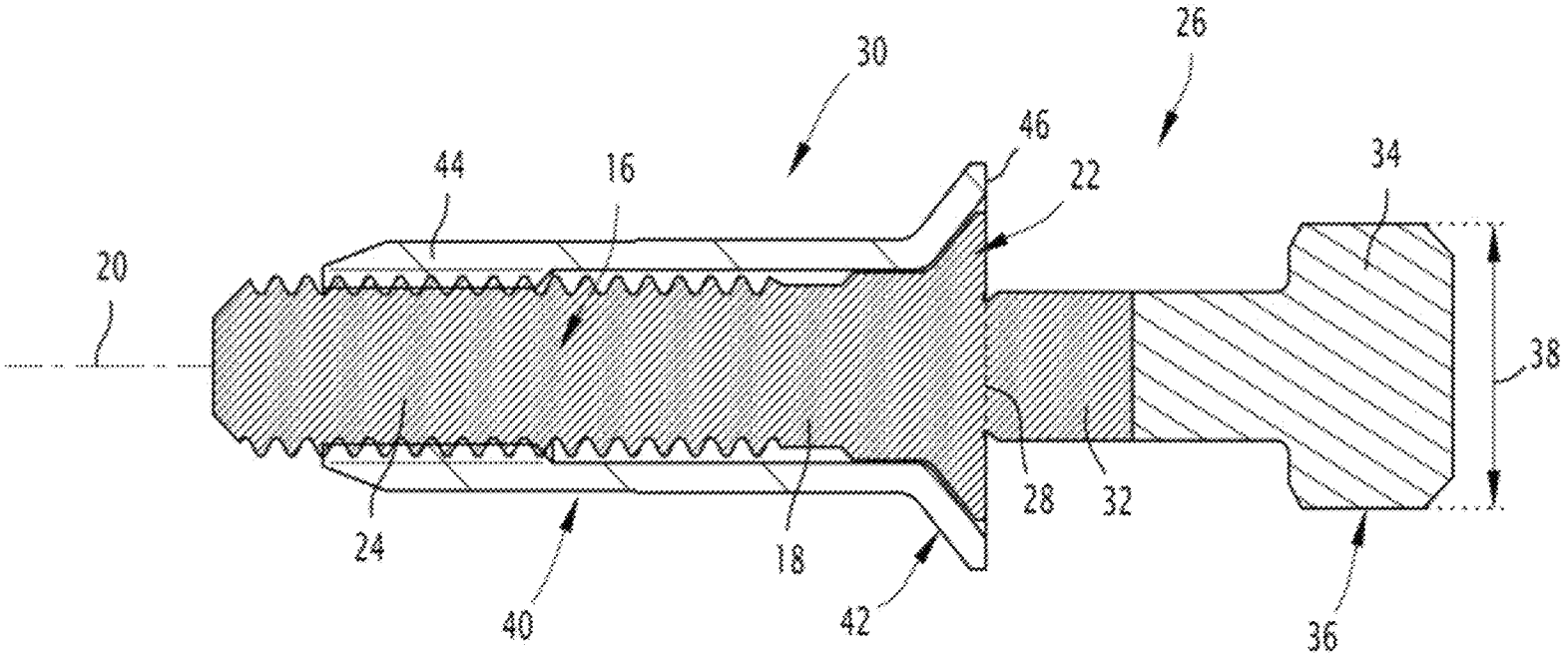
FIG. 7 is a cross-sectional view of a fastener able to be installed using the installation set shown in FIGS. 1 to 3.

FIG. 1 shows an installation set 10 according to one embodiment of the invention. The installation set 10 is notably intended for installing a fastener 12, shown in FIGS. 4 and 7, in a structure 14 shown in FIG. 4. The installation set 10 will be described in detail below.

The fastener 12 (FIG. 7) notably comprises a fastening rod 16, the rod 16 comprising: a solid shank 18, extending along a fastening axis 20; and a head 22, positioned at a first end of the shank. In the embodiment shown, the solid shank 18 is cylindrical and the head 22 is countersunk.

In the embodiment shown, the fastening rod 16 is a pin and further comprises a threaded portion 24, aligned with the solid shank 18 opposite the head 22. In the remainder of the description, the fastening rod 16 will be referred to as "pin 16".

In the embodiment shown, the fastener 12 further comprises: a gripping element 26; a breakneck groove 28; and a sleeve 30.

The gripping element 26 is formed from one piece with the pin 16 and comprises: a gripping rod 32 and a gripping knob 34.

The gripping rod 32 extends along the fastening axis 20, from the head 22 of the pin 16, opposite the solid shank 18.

The gripping knob 34 is positioned at one end of the gripping rod 32, opposite the head 22 of the pin. The gripping knob 34 forms a radial projection relative to the gripping rod 32.

Preferably, the gripping knob 34 comprises a first drive surface 36 positioned around the fastening axis 20. The first drive surface 36 comprises, for example, splines parallel to the fastening axis 20.

The gripping element 26 has a maximum radial dimension 38 perpendicular to the fastening axis 20. In particular, the maximum radial dimension 38 corresponds to a radial dimension of the gripping knob 34.

The breakneck groove 28 is formed between the head 22 of the pin 16 and the gripping rod 32. As will be described below, the breakneck groove 28 is likely to be broken under the application of a break torque around the fastening axis 20, so as to separate the pin 16 and the gripping element 26 from each other.

The sleeve 30 comprises: a tubular shank 40; a collar 42; and a tapped portion 44.

The tubular shank 40 is positioned around the solid shank 18 of the pin 16 along the fastening axis 20. The collar 42, adjacent to a first end of the tubular shank 40, is intended to come into contact with the head 22 of the pin. In the embodiment shown, an internal surface of the collar 42, which has a truncated cone shape, is substantially complementary to a surface of the countersunk head 22.

The collar comprises a bearing surface 46, perpendicular to the fastening axis 20 and forming one end of the collar.

The tapped portion 44, adjacent to a second end of the tubular shank 40, is intended to cooperate with the threaded portion 24 of the pin.

In the embodiment shown, the tubular shank 40 comprises a deformable area 48 (FIG. 4), close to the tapped portion 44. As described below, the deformable area 48 is intended to form a radial bulge during the installation of the fastener 12.

A fastener 12 similar to that described above is described in particular in document EP2894356 in the name of LISI Aerospace.

The structure 14 comprises a first face 50 and a second face 52, which are substantially parallel. In the embodiment shown, the first face 50 and second face 52 are flat.

The structure 14 further comprises a hole 54 opening onto the first face 50 and the second face 52. On the side of the first face 50, the hole 54 comprises a countersink able to accommodate the collar 42 of the sleeve 30.

In the embodiment shown in FIG. 1, the installation set 10 comprises: an installation nose 100; an installation tool 200; and an interface device 300 between the installation nose 100 and the installation tool 200.

In the embodiment shown, the installation nose 100, the interface device 300, and the tool 200 are assembled together in a manner that will be described later; and aligned along a first axis 102. In the remainder of the description, reference will be made to the first axis 102 to describe each of the installation nose 100, the installation tool 200 and the interface device 300 as such.

Figure 3:
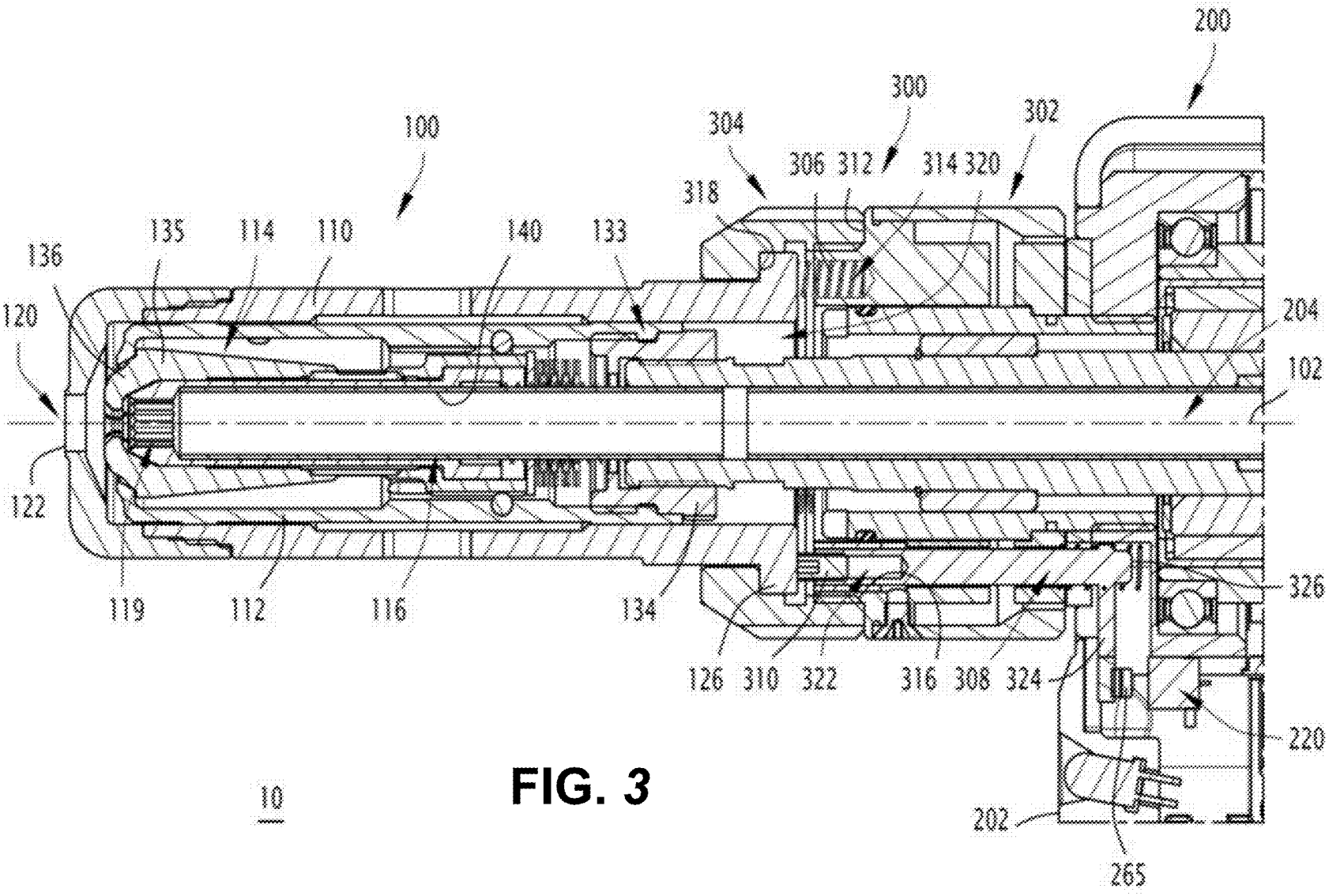
Figure 4:
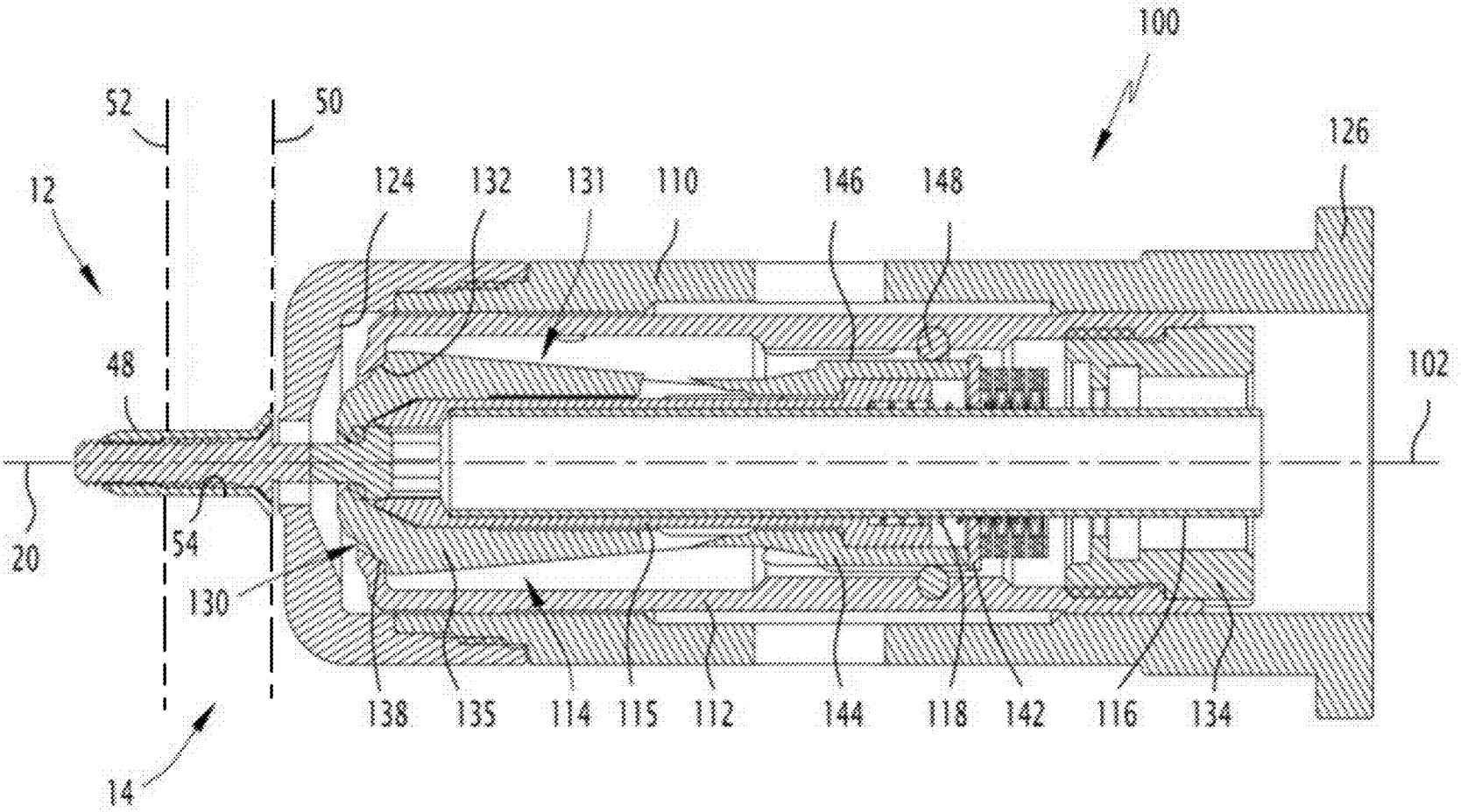
FIG. 4 is a cross-sectional view of an installation nose according to a first embodiment of the invention, forming part of the installation set in FIGS. 1 to 3.
Figure 5:
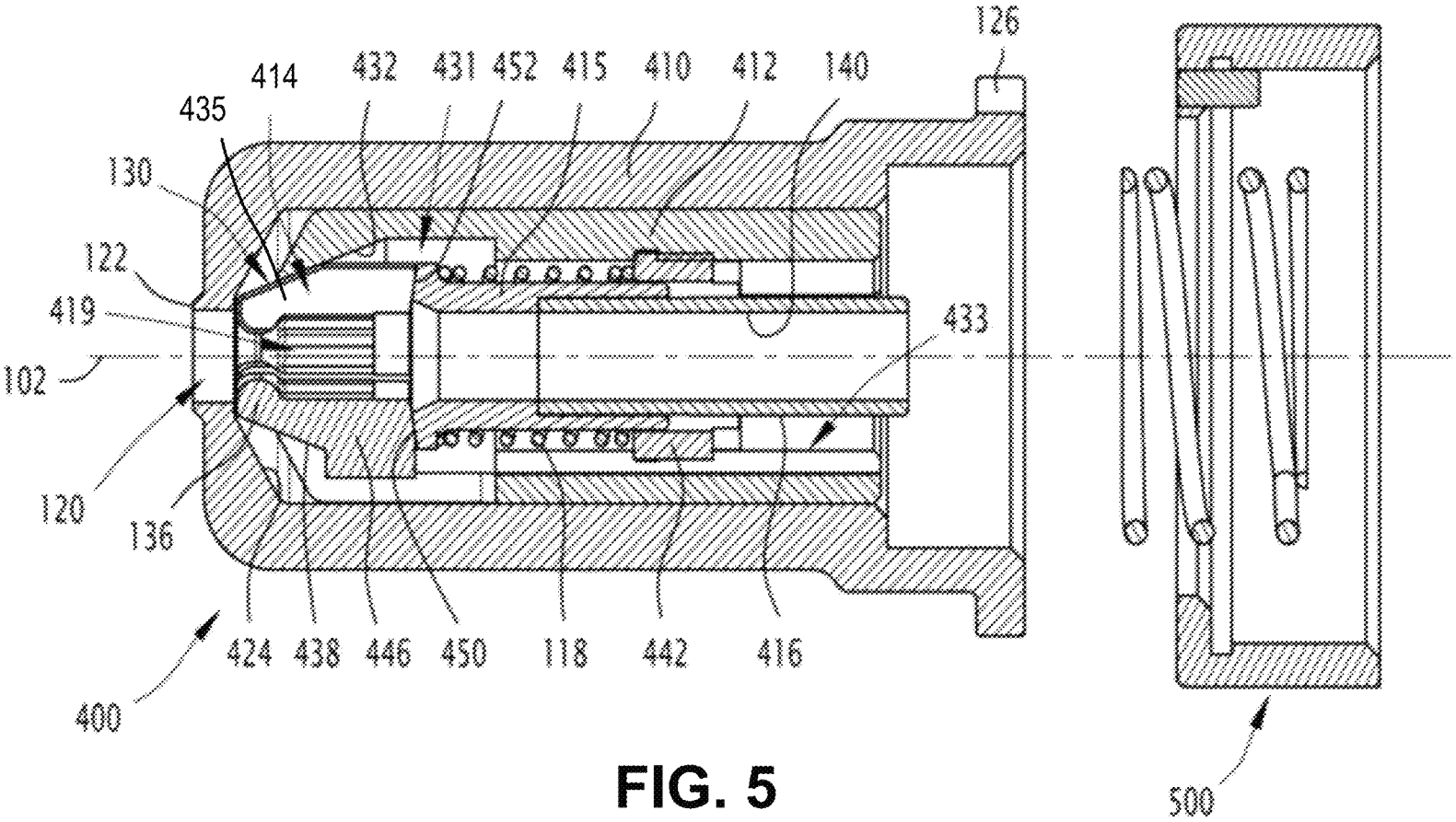
FIG. 5 is a cross-sectional view of an installation nose according to a second embodiment of the invention.
Figure 6:
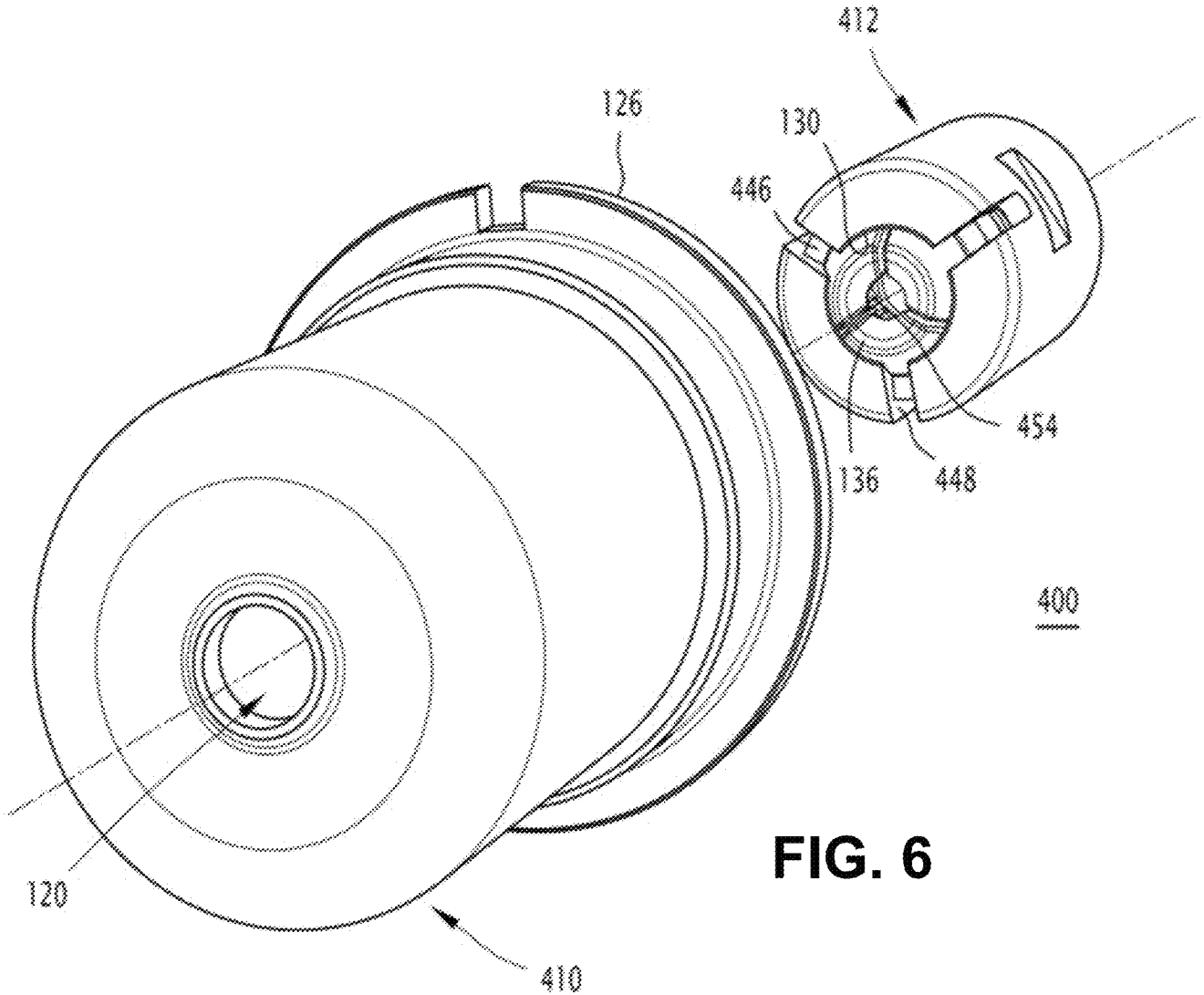
FIG. 6 is an exploded view of the installation nose shown in FIG. 5.

The installation nose 100 is shown in FIGS. 1 and 3-4. FIGS. 5 and 6 show an installation nose 400 according to a variant embodiment, which can replace the installation nose 100 in the installation set 10.

The installation noses 100 and 400 will be described simultaneously below. Common elements will be designated by the same reference numbers. It is considered that the installation nose 400 also extends along the first axis 102.

The installation noses 100, 400 each comprise: a hollow body 110, 410; a bushing 112, 412; a retaining device 114, 414; a first tubular element 115, 415, and a second tubular element 116, 416. In the embodiments shown, the installation noses 100, 400 further comprise: a first compression spring 118; and a second drive surface 119, 419.

The hollow body 110, 410 extends along the first axis 102 between a first end and a second end, hereinafter referred to as the "front end" and the "rear end". In the embodiments shown, the hollow body 110, 410 comprises a substantially cylindrical external radial surface of revolution.

The front end of the hollow body 110, 410 comprises a first front opening 120, able to accommodate the gripping element 26 of the fastener 12. In the remainder of the description of the installation set 10, the "front" orientation corresponds to the orientation towards the fastener 12 assembled on the installation nose 100.

In the embodiment shown, the front end of the hollow body 110, 410 further comprises a front lip 122, positioned around the first front opening 120 and facing the exterior of the hollow body. The front lip 122 forms a flat crown, perpendicular to the first axis 102.

Preferably, the flat crown formed by the front lip 122 is substantially superimposable on the bearing surface 46 of the collar 42 of the sleeve of the fastener 12. In other words, the front lip 122 and the bearing surface 46 have annular surfaces that are close to each other.

In a variant not shown, the flat crown formed by the front lip 122 is able to surround the bearing surface 46 of the collar 42. In other words, the front lip 122 has an external diameter greater than the external diameter of the bearing surface 46.

In the embodiment shown, the front end of the hollow body 110, 410 further comprises a stop 124, 424, positioned around the first front opening 120 and facing the interior of the hollow body.

The rear end of the hollow body 110, 410 comprises a flange 126, projecting radially relative to the external radial surface of the hollow body.

The bushing 112, 412 is accommodated in the hollow body 110, 410 and extends along the first axis 102 between a front end and a rear end. The front end of the bushing 112, 412 comprises a second front opening 130, axially aligned with the first front opening 120 of the hollow body.

In the embodiment shown, the front end of the bushing 112, 412 further comprises an internal chamber 131, 431 and an internal annular surface 132, 432.

The internal chamber 131, 431 has a radial dimension strictly greater than a radial dimension of the second front opening 130. The internal annular surface 132, 432 is positioned around the second front opening 130 and is located axially between the second front opening 130 and the internal chamber 131, 431.

In the embodiments shown, the internal annular surface 132, 432 has a concave truncated cone shape that flares out towards the internal chamber 131, 431 from the second front opening 130.

The rear end of the bushing 112, 412 comprises a coupling component 133, 433 for coupling with an element of the installation tool 200, as described later. The coupling component 133, 433 comprises, for example, a tapping formed on an internal surface of the bushing.

Optionally, as in the installation nose 100 in FIGS. 3-4, the coupling component 133 comprises an intermediate ring 134 to compensate for a difference in diameter between the bushing and the installation tool.

As described in more detail below, the bushing 112, 412 is movable in translation and rotation relative to the hollow body 110, 410.

The retaining device 114, 414 is able to block the gripping element 26 of the fastener 12 in the second front opening 130 of the bushing 112, 412.

Preferably, the retaining device 114, 414 comprises at least two clamps 135, 435, and more preferably at least three clamps. The clamps 135, 435 are at least partially accommodated in the bushing 112, 412 and angularly positioned around the first axis 102. A front end of each of the clamps comprises a hook 136.

In the embodiments shown, each of the clamps comprises an external annular surface 138, 438, positioned close to the hook 136. More specifically, in the embodiments shown, each external annular surface 138, 438 has the shape of a truncated cone portion complementary to the internal annular surface 132, 432 of the bushing 112, 412.

The clamps 135, 435 are radially movable relative to the hollow body 110, 410 between an extended configuration (not shown) and a retracted configuration (FIGS. 3-4 and 5-6), each hook 136 being closer to the first axis 102 in the retracted configuration than in the extended configuration.

The clamps 135, 435 are rotationally blocked relative to the bushing 112, 412, the bushing being able to drive the clamps in translation and rotation relative to the hollow body 110, 410.

The clamps 135, 435 are movable in translation in the bushing 112, 412 between a front position and a rear position.

In the front position of the clamps 135, 435, the clamps are held in the retracted configuration by the bushing 112, 412. In the embodiments shown, the retention in the retracted configuration is achieved through contact between the external annular surface 138, 438 of each clamp, in the front position, and the internal annular surface 132, 432 of the bushing.

In the rear position of the clamps 135, 435, the external annular surface 138, 438 of each clamp is axially spaced apart from the internal annular surface 132, 432 of the bushing. The clamps are able to move radially apart from each other in the internal chamber 131, 431 of the bushing.

The retaining device 114, 414 will be described in more detail below.

The first tubular element 115, 415 extends into the bushing 112, 412 along the first axis 102, between an open front end and an open rear end. The front end of the first tubular element 115, 415 comprises a bearing surface intended to come into contact with an internal surface of the clamps 135, 435, as will be described in more detail in the remainder of the description. The first tubular element 115, 415 also comprises a bearing surface for the first compression spring 118.

In the example of the installation nose 100 in FIGS. 3 and 4, the rear end of the first tubular element 115 comprises the bearing surface intended to accommodate one end of the first compression spring 118. The bearing surface is formed in this example by an internal shoulder of a crown positioned at the rear of the tubular element. In the example of the installation nose 400 in FIG. 5, the bearing surface is a collar positioned at the front of the first tubular element 415. Other embodiments of the bearing surface may be considered.

The hooks 136 of the clamps 135, 435 are axially positioned between the first front opening 120 of the hollow body 110, 410 and the front end of the first tubular element 115, 415.

The second tubular element 116, 416 extends partially into the first tubular element 115, 415 along the first axis 102, between an open front end and an open rear end. The front end of the second tubular element 116, 416 rests against an internal surface of the first tubular element 115, 415 adapted to form a stop.

An internal radial dimension of the second tubular element 116, 416, from the front end to the rear end of the second tubular element, is greater than or equal to the maximum radial dimension 38 of the gripping element 26 of the fastener 12.

Preferably, the second tubular element 116, 416 comprises a substantially cylindrical main internal surface 140 of revolution. More preferably, a radial dimension of the main internal surface 140 is strictly greater than the maximum radial dimension 38 of the gripping element 26.

The second tubular element 116, 416 is fixed in translation relative to the bushing 112, 412.

As will be described later, the bushing 112, 412 is able to drive the first tubular element 115, 415 in translation and rotation relative to the hollow body 110, 410. The first tubular element 115, 415 is also free to slide relative to the bushing 112, 412 and relative to the second tubular element 116, 416 under the effect of an axial thrust on the clamps 135, 435.

The first compression spring 118 is positioned radially between the first tubular element 115, 415 and the bushing 112, 412. The first compression spring 118 extends along the first axis 102 between two ends.

In the example of the installation nose 100 shown in FIGS. 3 and 4, the ends abut respectively against the internal shoulder of the crown positioned at the rear of the first tubular element 115 and against a washer 142 positioned on a portion of the second tubular element 116.

In the example of the installation nose 400 shown in FIG. 5, the ends abut respectively against the collar positioned at the front of the first tubular element 115 and against a ring 442 positioned around a portion of the first 415 and the second tubular element 416. The ring 442 is integral with the bushing 412.

The first tubular element 115, 415 is thus movable in translation in the bushing 112, 412 between a front position and a rear position relative to the first axis 102. In the front position of the first tubular element 115, 415, the first tubular element is closer to the first front opening 120 of the hollow body; and the first spring 118 is in a first state of compression. In the rear position of the first tubular element 115, 415, the first tubular element is further away from the first front opening 120 of the hollow body; and the first spring 118 is in a second state of compression, more compressed than the first state of compression.

The second drive surface 119, 419 is able to cooperate with the gripping element 26 of the fastener 12 to drive the gripping element in rotation. More specifically, the second drive surface 119, 419 is able to be assembled to the first drive surface 36 of the gripping knob 34. The second drive surface 119, 419 will be described in more detail below.

The installation nose 100 shown in FIGS. 1 and 3-4 will now be described in more detail.

The retaining device 114 of the installation nose 100 comprises an annular-shaped clamp body 144, positioned in the bushing 112 around the first tubular element 115. A rear end of each clamp 135 is integral with the clamp body 144.

Each clamp 135 is elastically deformable between the retracted and extended configurations. In the embodiment shown, the retaining device 114 comprises six elastically deformable clamps 135.

The clamp body 144 is rotationally blocked in the bushing 112. In the embodiment shown, the clamp body 144 comprises flats 146 and is assembled to the bushing through keys 148, which allow the clamp body 144 to slide axially in the bushing 112.

The second tubular element 116 is rotationally blocked in the clamp body 144. In the embodiment shown, the clamp body 144 comprises an axially extending recess on the external surface of the crown. The recess has a semicircular cross-section and accommodates a rod with a circular cross-section. The rear portion of the clamp body 144 comprises, on a portion of the internal surface, an axially extending recess with a semicircular cross-section. The second tubular element 116 is assembled to the clamp body by the rod. The presence of the rod prevents the rotation of one element relative to the other.

Moreover, in the installation nose 100, the second drive surface 119 is formed by the front end of the first tubular element 115.

The installation nose 400 shown in FIGS. 5 and 6 will now be described in more detail.

The retaining device 414 of the installation nose 400 comprises a plurality of tabs 446, each of the tabs being integral with one of the clamps 435. In the embodiment shown, the retaining device 414 comprises three clamps 435 and three tabs 446.

In addition, the front end of the bushing 412 comprises a plurality of axial slots 448, angularly positioned around the first axis 102. Each tab 446 is positioned in one of the axial slots 448 and is able to slide in the axial slot, between the front position and the rear position of the corresponding clamp 435.

Moreover, the front end of the first tubular element 415 comprises a front surface 450; and a rear end of each of the clamps comprises a rear surface 452, able to slide radially against the front surface 450.

The front surface 450 has a non-zero angle with the first axis 102. Preferably, the front surface 450 forms an angle of between 0° and 15° with a plane perpendicular to the first axis 102.

In the embodiment shown, the front surface 450 of the first tubular element 415 has the shape of a convex truncated cone, and the rear surface 452 of each clamp 435 has the shape of a portion of a concave truncated cone, substantially complementary to the front surface 450.

Moreover, in the installation nose 400, the second drive surface 419 is formed by the internal surfaces of the clamps 435 in the retracted configuration. More specifically, each clamp 435 comprises an internal surface 454, oriented towards the first axis 102 and forming a portion of the second drive surface 419.

Figure 6A:
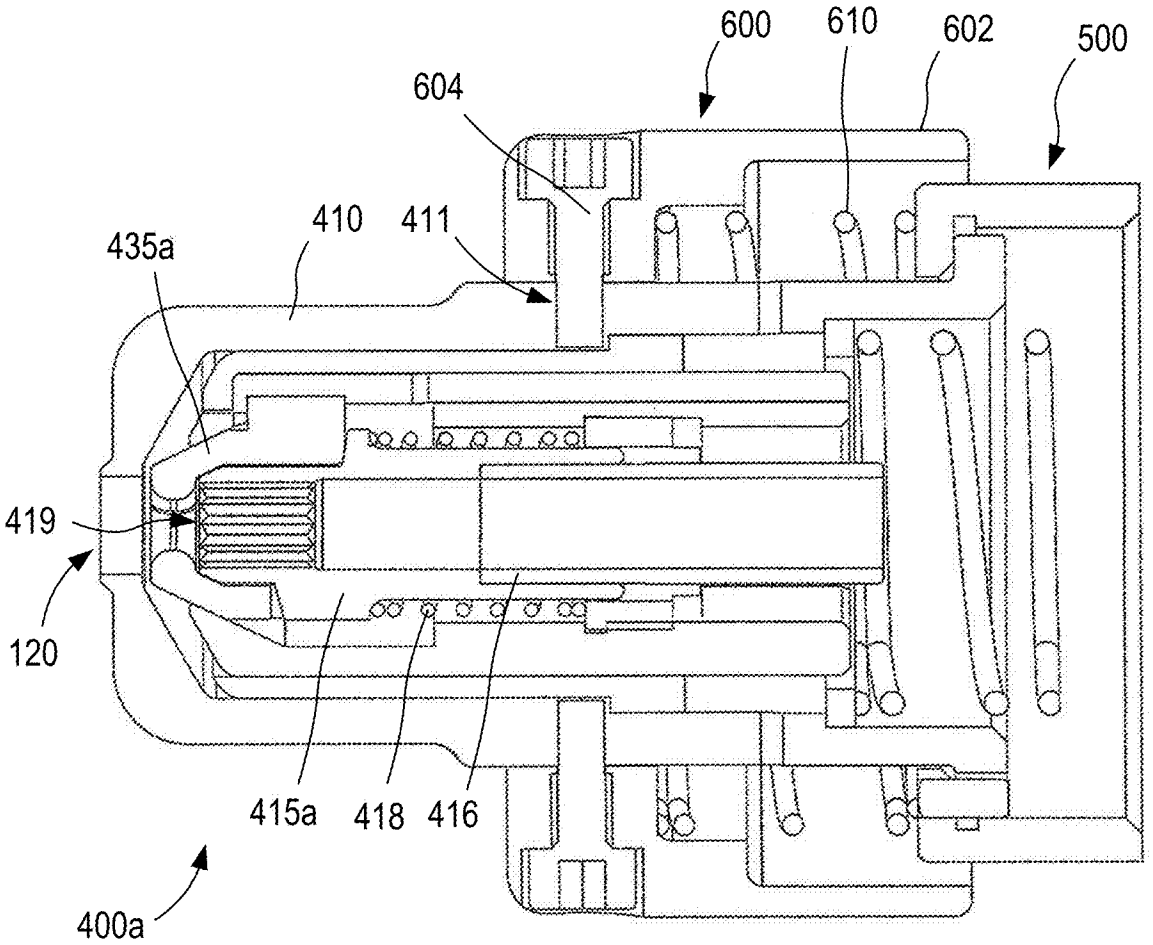
FIG. 6A is a cross-sectional view of an installation nose according to a third embodiment of the invention.

In other implementations, the second drive surface 119 may be part of other structures. To that end, the exemplary installation nose 400*a* in FIG. 6A. is substantially similar to installation nose 400 and similar elements are represented by similar reference numerals. For example, the installation nose 400*a* includes a hollow body 410 (with a first opening 120), a second drive surface 419, a first spring 118, a second tubular element 416 and other elements described above with reference to FIGS. 5 and 6. Here, however, the second drive surface 419 is not part of the clamps 435*a*, and is instead part of the first tubular element 415*a*. The clamps 435*a* are fitted over a portion of the first tubular element 415*a*.

Installation sets in accordance with the present inventions may also include a manually operable actuator that may be used to release a fastener from the clamps so that the fastener can fall out of the first front opening of the installation nose when the installation tool is pointed downwardly, or be otherwise removed by way of the first front opening. Such removal may be useful when the installation process is unsuccessful and the gripping element 26 is not broken. For example, the manually operable actuator 600 illustrated in FIG. 6A includes a ring 602, at least two pins 604 that secure the ring 602 to the installation nose 400*a* by way of apertures 411 in the hollow body 410, and a compressed spring 610 located between the ring 500 and the inner surface of the ring 602. When the user pulls the ring 602 towards the ring 500, the hollow body 410 moves back, which causes the clamps 435*a* to move radially outwardly thereby releasing the fastener.

Figure 2:
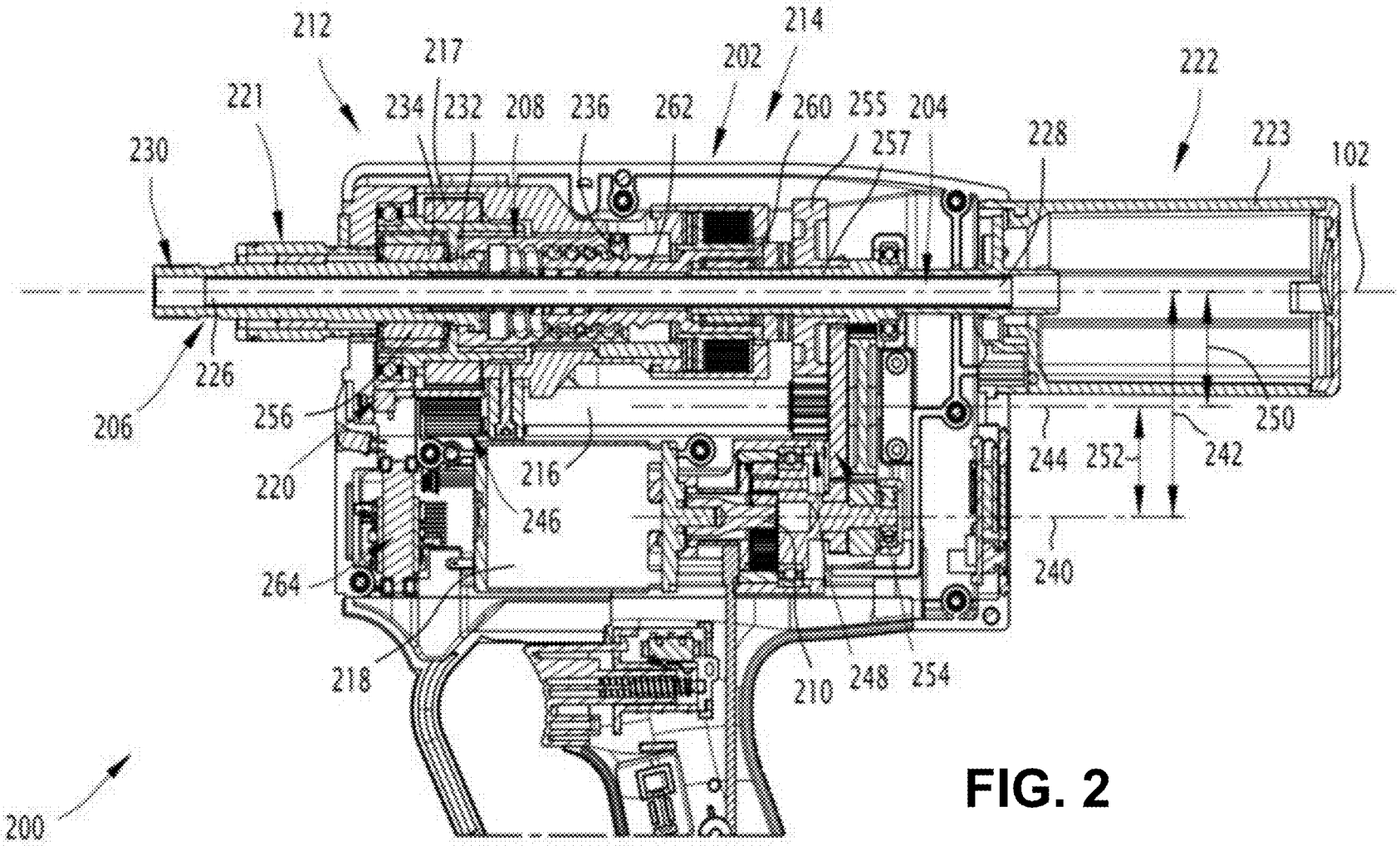
FIGS. 2 and 3 are partial cross-sectional views of the installation set shown in FIG. 1.

The installation tool 200 of the installation set 10, shown in FIGS. 1 and 2, will now be described.

The installation tool 200 comprises: a tool housing 202; a tube 204; a first sheath 206 and a second sheath 208; a first rotary shaft 210; and a first transmission device 212 and a second transmission device 214. In the embodiment shown, the installation tool 200 further comprises: a second rotary shaft 216; a motor 218; an electrical circuit 219 connected to the motor; and a first switch 220.

The tool housing 202 comprises an open front end 221 and a rear end 222, aligned along the first axis 102. In the embodiment shown, the rear end 222 of the tool housing comprises a removable receptacle 223, positioned along the first axis 102.

Moreover, in the embodiment shown, the tool housing 202 comprises: a main housing 224, through which the tube 204 extends; and a handle 225. The handle 225 is able to be gripped by an operator.

The tube 204 is accommodated in the tool housing 202 and extends along the first axis 102, between an open front end 226 and an open rear end 228. The front end 226 of the tube 204 projects axially relative to the front end 221 of the tool housing 202. The rear end 228 of the tube 204 is accommodated inside the tool housing 202. In the embodiment shown, the rear end 228 of the tube 204 opens into the receptacle 223.

In the embodiment shown, the tube 204 is fixed relative to the tool housing 202.

An internal radial dimension of the tube 204, from the front end 226 to the rear end 228 of the tube, is greater than or equal to the maximum radial dimension 38 of the gripping element 26 of the fastener 12. Preferably, the tube 204 has a substantially constant internal radial dimension along the first axis 102. The internal radial dimension is substantially equal to the radial dimension of the main internal surface 140 of the second tubular element 116, 416 of the installation nose 100, 400 described earlier.

The first sheath 206 extends into the tool housing 202 along the first axis 102, between a front end 230 and a rear end 232. The first sheath 206 is positioned around the tube 204.

The first sheath 206 is close to the front end 221 of the tool housing 202. More specifically, the front end 230 of the first sheath 206 projects axially relative to the front end 221 of the tool housing 202 and relative to the front end 226 of the tube 204.

In the installation set 10, the front end 230 of the first sheath 206 is fastened to the rear end of the bushing 112 of the installation nose 100, by means of the coupling component 133.

Moreover, in the installation set 10, the front end 230 of the first sheath 206 is positioned around the rear end of the second tubular element 116 of the installation nose 100, in such a way as to establish communication between the second tubular element 116 and the tube 204 along the first axis 102.

As detailed below, the first sheath 206 is movable in rotation and in translation relative to the tool housing 202 along the first axis 102.

The second sheath 208 extends into the tool housing 202 along the first axis 102, between a front end 234 and a rear end 236. The second sheath 208 is positioned around the tube 204.

The second sheath 208 is closer to the rear end 222 of the tool housing 202 than the first sheath 206. More specifically, the front end 234 of the second sheath 208 is assembled to the rear end 232 of the first sheath 206.

As detailed below, the second sheath 208 is configured to drive the first sheath 206 in translation relative to the tool housing, along the first axis 102.

The first rotary shaft 210 is accommodated in the tool housing 202 and extends along a second axis 240, the first 102 and second 240 axes being separated by a first non-zero distance 242. In the embodiment shown, the first 102 and second 240 axes are parallel.

In the embodiment shown, the first rotary shaft 210 is positioned in the main housing 224 of the tool housing.

The first transmission device 212 is accommodated in the tool housing 202 and connected to the first rotary shaft 210. As detailed below, the first transmission device 212 is able to drive the first sheath 206 in rotation under the effect of rotation of the first rotary shaft 210 in a first direction.

The second transmission device 214 is accommodated in the tool housing 202 and connected to the first rotary shaft 210. As detailed below, the second transmission device 214 is able to drive the second sheath 208 in translation under the effect of rotation of the first rotary shaft 210 in a second direction, opposite to the first direction.

The second rotary shaft 216 is accommodated in the tool housing 202 and extends along a third axis 244, between a front end 246 and a rear end 248. The third axis is separated from the first 102 and second 230 axes by a second 250 and a third 252 non-zero distance, respectively. Preferably, the third axis 244 is parallel to the first axis 102. In the embodiment shown, the third axis 244 is parallel to the first 102 and second 240 axes.

In the embodiment shown, the second rotary shaft 216 is positioned in the main housing 224 of the tool housing 202.

The first transmission device 212 comprises a first gear train 254, a bearing 217, and a first free wheel 256.

The first 210 and second 216 rotary shafts are connected by the first gear train 254, such that rotation of the first rotary shaft 210 in each direction of rotation drives the second rotary shaft 216 in a corresponding direction of rotation.

The front end 246 of the second rotary shaft 216 is connected to the bearing 217, which is, for example, a roller bearing. More specifically, the bearing 217 connects the second rotary shaft 216 to the first free wheel 256, positioned on the first sheath 206.

The first free wheel 256 is able to drive the first sheath 206 in rotation under the effect of rotation of the first rotary shaft 210 in the first direction, by means of the first transmission device 212. In the event of rotation of the first rotary shaft 210 in the second direction, the first free wheel 256 does not drive the first sheath 206 in rotation.

Moreover, the second transmission device 214 comprises: the first gear train 254, a second gear train 255, a hollow shaft 257, a second free wheel 260; and a drive element 262, able to be driven in rotation by the second free wheel, under the effect of rotation of the first rotary shaft 210 in the second direction. The drive element 262 cooperates with the second sheath 208, so as to move the second sheath in translation along the first axis.

The second gear train 255 connects the second rotary shaft 216 to the hollow shaft 257. The hollow shaft 257 is positioned on a rear portion of the tube 204. The second free wheel 260 is positioned along the first axis 102 and placed between the hollow shaft 257 and a rear end of the drive element 262. In the event of rotation of the first rotary shaft 210 in the first direction, the second free wheel 260 does not drive the drive element 262 in rotation.

In the embodiment shown, the drive element 262 is a ball pin. In a variant not shown, the drive element 262 is a threaded pin, a roller pin or a worm pin.

The motor 218 is an electric motor accommodated in the tool housing 202, preferably in the main housing 224. In the embodiment shown, the first rotary shaft 210 forms an output shaft of the motor.

The electrical circuit 219 is connected to the motor 218. In the embodiment shown, the installation tool 200 comprises an electronic module 264 which at least partially embodies the electrical circuit 219.

The first switch 220 is accommodated inside the tool housing 202 and integrated into the electrical circuit 219. The first switch 220 is mechanically movable between an open state, shown in FIG. 2, and a closed state. In the open state of the first switch 220, the electrical circuit 219 is interrupted.

Preferably, the first switch 220 comprises an elastic blade 265 (FIG. 3) which, in its resting position, keeps the first switch open. Pressing on the elastic blade allows the first switch to be closed.

In the embodiment shown, the installation tool 200 further comprises an electrical power supply 266 for the motor, connected to the electrical circuit 219. The electrical power supply is, for example, an electric battery 266 connected to the tool housing 202. Preferably, the electric battery 266 is removably fastened to the handle 225, opposite the main housing 224. The electric battery 266 thus forms a counterweight to the main housing, improving the ergonomics of the tool 200.

Moreover, in the embodiment shown, the installation tool 200 further comprises: a second switch (not shown); and a trigger 268.

The second switch is integrated into the electrical circuit 219 and movable between an open state and a closed state. In the open state of the second switch, the electrical circuit 219 is interrupted.

The trigger 268 is installed on the handle 225 of the tool housing 202. Preferably, when the operator presses the trigger, the second switch is placed in the closed state; and if the trigger is not pressed, the second switch is in the open state.

Preferably, when each of the first switch 220 and the second switch is in the closed state, the electrical circuit 219 is closed and allows the electric battery 266 to power the motor 218.

The interface device 300 of the installation set 10, shown in FIGS. 1 and 3, will now be described.

The interface device 300 comprises: an interface body 302; an assembly ring 304; at least one second compression spring 306; and a contact rod 308. Preferably, as specified below, the interface device 300 further comprises a pressure sensor (not shown).

The interface body 302 has an annular shape and extends along the first axis 102 between a front end and a rear end.

The front end of the interface body 302 comprises a front face 312 in the form of a flat crown, perpendicular to the first axis 102.

The front end of the interface body 302 further comprises at least one spring housing 314 opening onto the front face 312. Preferably, the front end of the interface body 302 comprises several spring housings 314 distributed angularly around the first axis 102.

The interface body 302 further comprises a through hole 316, parallel to the first axis 102. The through hole 316 is open on the front face 312 and on the rear end of the interface body 302.

The assembly ring 304 has an annular shape and extends along the first axis 102 between a front end and a rear end. The assembly ring 304 comprises an internal shoulder 318 oriented towards the rear end of the assembly ring.

The rear end of the assembly ring 304 is assembled to the front end of the interface body 302, for example by a threading/tapping system. The assembly ring 304 thus comprises an internal cavity 320, delimited along the first axis 102 by the internal shoulder 318 on the one hand, and by the front face 312 of the interface body 302 on the other hand.

The at least one second compression spring 306 is fastened to the interface body 302 and projects axially relative to the front face 312. In the embodiment shown, a rear end of the second compression spring 306 is inserted into the or one of the spring housings 314.

In a first state of compression of the second spring 306, a front end of the second spring is positioned in the internal cavity 320, projecting axially relative to the front face 312 of the interface body 302. In a second state of compression of the second spring 306, more compressed than the first state, the front end of the second spring is positioned in the spring housing 314 and is flush with the front face 312 of the interface body.

Preferably, the interface device 300 comprises several second compression springs 306, the rear end of each of the second springs being inserted into one of the spring housings 314.

The contact rod 308 extends parallel to the first axis 102 between a front end and a rear end. The contact rod 308 is positioned in the through hole 316 of the interface body 302 and is able to slide axially in the through hole.

Preferably, the front end of the contact rod 308 comprises a tapped housing, open towards the front, capable of accommodating a threaded pin 310, in order to manually adjust the flush stroke of the contact rod, in particular depending on the stiffness of the compression springs 314.

As described below, the rear end of the contact rod 308 is able to actuate the first switch 220 of the installation tool 200. In the embodiment shown, the rear end of the contact rod 308 comprises an actuating arm 324, positioned in the tool housing 202 of the installation tool.

Moreover, the interface device 300 comprises a third compression spring 326, extending parallel to the first axis 102. A front end of the third spring 326 is assembled to the rear end of the contact rod 308. A rear end of the third spring 326 bears against, or is fastened to, the tool housing 202 of the installation tool 200.

The pin 310, which is optional, is positioned in the housing 322 of the contact rod 308. Preferably, as shown in FIG. 3, the pin 310 is assembled in the housing 322 such that a front end of the pin projects slightly relative to the front end of the contact rod 308.

Preferably, the interface body 302 comprises at least one strain gage, and preferably at least three strain gages, so as to form the pressure sensor. The pressure sensor is connected to the electronic module 264 of the installation tool 200. The pressure sensor is used to measure the tensile force on the pin 16 by measuring the compressive force between the structure 14 and the tool housing 202 of the installation tool, when the front lip 122 of the installation nose 100 rests on the collar 42 of the sleeve inserted into the hole 54 of the structure and traction is applied to the pin 16.

In a first configuration of the installation set 10, shown in FIG. 3, the flange 126 of the hollow body 110 of the installation nose 100 is in contact with the internal shoulder 318 of the assembly ring 304; each of the second springs 306 is in the first state of compression; the front end of the pin 310 or of the contact rod 308 projects axially relative to the front face 312 of the interface body; and the first switch 220 is open.

In a second configuration (not shown) of the installation set 10, the flange 126 of the hollow body of the installation nose is in contact with the front face 312 of the interface body; the front end of the pin 310 or of the contact rod 308 is in contact with the flange 126 and substantially coplanar with the front face 312; each of the second springs 306 is in the second state of compression, more compressed than the first state; and the first switch 220 is closed.

More specifically, in the first configuration of the installation set 10, the third spring 326 is in a first state of compression; and the actuating arm 324 of the contact rod 308 is spaced apart from the first switch 220 along the first axis 102; and in the second configuration of the installation set 10, the third spring 326 is in a second state of compression, more compressed than the first state; and the actuating arm 324 of the contact rod 308 presses on the first switch 220 so as to keep the first switch closed.

According to a variant embodiment (not shown) of the installation set, the installation set does not comprise the interface device 300; and the installation nose 100, 400 and the installation tool 200 are assembled by an interface nut 500, shown in FIG. 5. The flange 126 of the hollow body 110, 410 of the installation nose 100, 400 is then axially fixed relative to the front end 221 of the tool housing 202 of the installation tool.

According to the variant embodiment of the installation set, comprising the interface nut 500, the first switch 220 of the installation tool 200 is kept permanently closed.

A method for installing the fastener 12 in the structure 14, using the installation set 10, will now be described.

The installation method notably comprises: a first placement step; a second actuation step; and a third removal step.

The first placement step is carried out, for example, as follows:

First, the fastener 12 is inserted into the hole 54 of the structure 14. More specifically, the tubular shank 40 of the sleeve 30, containing the pin 16, is inserted into the hole 54 as shown in FIG. 4. The head 22 of the pin 16 and the collar 42 of the sleeve 30 are thus positioned on the side of the first face 50; and the deformable area 48 of the tubular shank 40 of the sleeve emerges on the side of the second face 52.

Next, an operator brings the installation set 10 close to the gripping element 26 of the fastener 12. The operator presses the trigger 268, thereby closing the second switch of the installation tool 200; and inserts the gripping knob 34 into the first front opening 120 of the installation nose 100, 400. The operator positions the installation set 10 so that the first axis 102 is aligned with the fastening axis 20.

The installation set 10 is then in the first configuration described earlier. In other words, the flange 126 of the installation nose 100, 400 is in contact with the internal shoulder 318 of the clamping ring 304; and the first switch 220 is open, thereby cutting off the power supply to the motor 218 of the installation tool 200.

Next, the operator pushes the installation set 10 towards the structure 14 along the first axis 102. The gripping knob 34 comes into contact with the hooks 136 of the clamps 135, 435 in the retracted configuration.

As the axial thrust continues, the first spring 118 compresses and the clamps 135, 435 and the tubular element 116, 416 move from the front position to the rear position. The gripping knob 34, in contact with the hooks 136, moves the clamps 135, 435 radially from the retracted configuration to the extended configuration. In the first embodiment of the installation nose 100, the clamps 135 elastically deform around the clamp body 144. In the second embodiment of the installation nose 400, the rear surface 452 of each clamp 435 slides radially against the front surface 416 of the first tubular element 115.

As the axial thrust continues, the hooks 136 of the clamps extend beyond the gripping knob 34 and close around the gripping rod 32. The clamps 135, 435 thus return to the retracted configuration. Simultaneously, the first spring 118 relaxes, and the clamps 135, 435 and the first tubular element 115, 415 move from the rear position to the front position; and the second drive surface 119, 419 of the installation nose 100, 400 engages with the first drive surface 36 of the fastener.

The gripping element 26 of the fastener 12 is thus blocked in the bushing 112, 412 by the retaining device 114, 414 of the installation nose 100, 400.

As the axial thrust continues, the front lip 122 of the installation nose 100, 400 comes into contact with the bearing surface 46 of the collar 42 of the sleeve 30. The hollow body 110, 410 of the installation nose 100, 400 is then moved backwards relative to the tool 200.

During the backward movement of the hollow body 110, 410, the rear stop 124, 424 of the hollow body comes into contact with the hooks 136 of the clamps 135, 435.

Moreover, the backward movement of the hollow body 110, 410 causes the installation set 10 to move from the first configuration to the second configuration. In other words, the flange 126 of the hollow body 110, 410 moves backwards into the internal cavity 320 of the clamping ring 304, pushing back the contact rod 308. The actuating arm 324 of the contact rod places the first switch 220 in the closed position, enabling power to be supplied to the motor 218 of the installation tool 200.

The first placement step is thus completed. According to a variant embodiment, the locking of the gripping element 26 of the fastener by the retaining device 114, 414 of the installation nose 100, 400 is performed before the insertion of the fastener 12 into the hole of the structure 14.

The second actuation step is carried out, for example, as follows:

An actuation method is then implemented by the tool 200. The method is executed, for example, by a program stored in the electronic module 264. In particular, the electronic module 264 is able to process the signals emitted by the pressure sensor to determine a tensile force, command the stop of the first rotary shaft 210 in the second direction when the tensile force reaches a predetermined force setpoint, and then command the rotation of the first rotary shaft 210 in the first direction.

In a first phase of the actuation method, the first rotary shaft 210 of the installation tool 200 is rotated in the second direction. The second sheath 208 of the tool 200 is thus moved backwards in translation, by means of the second transmission device 214.

The second sheath 208 drives the first sheath 206 backwards in translation, while the axial thrust of the installation nose 100, 400 towards the structure 14 is maintained. The pin 16 of the fastener 12 is thus pulled backwards, while the sleeve 30 is held in place by contact between the front lip 122 and the bearing surface 46.

The traction on the pin 16 causes the deformable area 48 of the sleeve 30 to form a radial bulge against the second face 52 of the structure 14, as described in document EP2894356.

In a second phase of the actuation method, the rotation of the motor in the second direction is stopped; then the first rotary shaft 210 of the installation tool 200 is rotated in the first direction. The first sheath 206 of the tool 200 is thus driven in rotation by means of the first transmission device 212.

The threaded portion 24 of the pin 16 is thus screwed into the tapped portion 44 of the sleeve 30, until the head 22 of the pin comes into contact with the collar 42 of the sleeve.

The rotation of the first sheath 206 continues until the breakneck groove 28 breaks, under the effect of the torsion torque applied to the gripping element 26. When the groove breaks, the electronic module 264 commands the motor to stop rotating. The second actuation step is thus completed. Optionally, during the second actuation step, the pressure sensor described above measures compression between the hollow body 110, 410 of the installation nose and the interface body 302.

The third removal step is carried out, for example, as follows:

After the breakage of the breakneck groove 28 of the fastener 12, the operator stops the axial force of the installation set 10 towards the structure 14. The installation set 10, spaced apart from the structure 14, changes from the second configuration to the first configuration. The motor 218 can thus no longer be started unexpectedly, even if the operator presses the trigger 268.

The pin 16 and the sleeve 30 remain assembled to the structure 14, while the gripping element 26, separated from the pin 16, remains held in the installation nose 100, 400.

Next, the operator tilts the installation nose 100, 400 upwards. The gripping element 26 thus moves by gravity along the first axis 102, from the front end of the tubular element 116, 416 of the installation nose 100, 400 to the rear end 228 of the tube 204 of the installation tool. The gripping element 26 is thus stored in the removable receptacle 223, which prevents it from being unexpectedly ejected from the installation tool 200.

In a variant, the gripping element 26 is removed to the tube 204 of the tool 200 by the insertion of the gripping element 26 of a new fastener 12 into the installation nose 100, 400.

According to the variant embodiment of the installation set described above, comprising the interface nut 500, only the second switch of the installation tool 200 allows the electrical circuit 219 to be opened or closed. The start-up of the motor 218 therefore depends solely on the operator actuating the trigger 268, and not on the axial bearing of the installation set against the structure 14.

The installation set 10 described above, in particular the installation nose 100, 400, allows the gripping element 26 of the fastener 12 to be removed after breakage through the rear of the installation set 10. This facilitates the insertion of a new gripping element into the installation nose.

Moreover, the installation set 10 allows the gripping element 26 to be temporarily stored in the receptacle 223, thus preventing the gripping element from being unexpectedly ejected and posing a risk to the operator, or from being lost in the structure.

The invention claimed is:

1. An installation nose for installing a fastener in a structure, the fastener including a pin extending along a fastening axis and provided with a head, a gripping element, projecting axially relative to said head, and a breakneck groove, positioned between said head and said gripping element, configured to break under the application of a break torque around the fastening axis, the installation nose comprising:

a hollow body, extending along a main axis, a front end of the hollow body comprising a first front opening, able to accommodate the gripping element of the fastener;

a bushing, accommodated in the hollow body and movable in translation and rotation relative to said hollow body, a front end of the bushing comprising a second front opening, axially aligned with the first front opening of the hollow body;

a retaining device, able to block the gripping element of the fastener in the second front opening of the bushing; and a first tubular element, extending into the bushing along the main axis, between an open front end and an open rear end; the front end of the first tubular element being held in contact with the retaining device; an internal radial dimension of the first tubular element, from the front end to the rear end, being greater than or equal to a maximum radial dimension of the gripping element of the fastener; the retaining device and the first tubular element being movable in translation in the bushing between a first axial position and a second axial position.

2. The installation nose according to claim 1, wherein the retaining device comprises at least two clamps, at least partially accommodated in the bushing and positioned around the main axis; a front end of each of the clamps comprising a hook; the clamps being radially movable relative to the hollow body between an extended configuration and a retracted configuration, each hook being closer to the main axis in the retracted configuration than in the extended configuration.

3. The installation nose according to claim 2, wherein, in the first axial position, the clamps are held in the retracted configuration and in the second axial position, the clamps are in the extended configuration.

4. The installation nose according to claim 3, wherein: the second front opening of the bushing has a first radial dimension; the front end of the bushing comprises an internal surface widening towards the rear, such that at a predetermined distance from the second opening, said internal surface has a second radial dimension, strictly greater than the first radial dimension; and in the first axial position of the clamps, the hooks are positioned in the second front opening of the bushing.

5. The installation nose according to claim 2, further comprising:

a drive surface, able to cooperate with the gripping element of the fastener to drive said gripping element in rotation;

wherein the drive surface is formed by the clamps in the retracted configuration.

6. The installation nose according to claim 2, wherein the retaining device further comprises a clamp body integral with a rear end of each of the clamps, the clamp body being rotationally blocked in the bushing.

7. The installation nose according to claim 6, wherein: the front end of the bushing comprises at least two axial slots, positioned around the main axis; the front end of the first tubular element comprises a front surface, substantially perpendicular to the main axis; each clamp comprises a tab, able to slide in one of the axial slots of the bushing, between the first and the second axial positions; and a rear end of each of the clamps comprises a rear surface, able to slide radially against the front surface of the front end of the first tubular element.

8. The installation nose according to claim 7, wherein the front surface of the front end of the tubular element forms an angle of between 0° and 15° with a line perpendicular to the main axis.

9. The installation nose according to claim 1, further comprising:

a first compression spring, extending along the main axis between two ends; and a second tubular element, extending into the first tubular element along the main axis between an open front end and an open rear end, the second tubular element being fixed in translation relative to the bushing, the first compression spring abutting respectively against the first tubular element and against one of the second tubular element and the bushing, the first and second positions of the first tubular element corresponding respectively to a first and a second state of compression of the first spring.

10. The installation nose according to claim 1, further comprising a drive surface, able to cooperate with the gripping element of the fastener to drive said gripping element in rotation.

11. The installation nose according to claim 10, wherein the drive surface is carried by the front end of the first tubular element.

* * * * *